US008602502B2

(12) United States Patent
Niederriter et al.

(10) Patent No.: US 8,602,502 B2
(45) Date of Patent: Dec. 10, 2013

(54) ARTICULATED SHEARER

(75) Inventors: Edward F. Niederriter, Fryburg, PA (US); Shawn W. Franklin, Emlenton, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 57 days.

(21) Appl. No.: 13/329,762

(22) Filed: Dec. 19, 2011

(65) Prior Publication Data

US 2013/0154341 A1 Jun. 20, 2013

(51) Int. Cl.
*E21C 29/02* (2006.01)

(52) U.S. Cl.
USPC ..... 299/42; 299/53

(58) Field of Classification Search
USPC ..... 299/42, 45, 47, 48, 51, 52, 53, 54, 32, 299/34.01, 34.04
See application file for complete search history.

(56) References Cited

U.S. PATENT DOCUMENTS 3,378,306 A * 4/1968 Lobbe ..... 299/34.1
3,431,024 A * 3/1969 Braun et al. ..... 299/34.04
3,877,752 A * 4/1975 Hauschopp et al. ..... 299/34.11
4,435,018 A 3/1984 Parrott
4,461,512 A * 7/1984 Sirotin et al. ..... 299/42
4,645,265 A * 2/1987 Braun et al. ..... 299/45
5,228,751 A 7/1993 Ramsden, Jr.
7,347,501 B2 * 3/2008 Bettermann et al. ..... 299/34.09

FOREIGN PATENT DOCUMENTS

| | | |
|---|---|---|
| CN | 202381092 | 8/2012 |
| CN | 102777173 | 11/2012 |
| PL | 286864 | 4/1992 |

OTHER PUBLICATIONS

P30738PL00/KJ Search Report dated Mar. 14, 2013 (2 pages).

* cited by examiner

*Primary Examiner* — David Bagnell
*Assistant Examiner* — Michael Goodwin
(74) *Attorney, Agent, or Firm* — Michael Best & Friedrich LLP

(57) ABSTRACT

A longwall shearer mining machine that is mounted on a rail generally includes a first chassis portion with a first cutting arm mounted thereto and a second chassis portion with a second cutting arm mounted thereto. Each of the first and the second chassis portions is slidably coupled to the rail. The first and second chassis portions are coupled at a pivot joint. The pivot joint allows each of the first and the second chassis portions to adjust its respective orientation with respect to a horizontal ground plane when the articulated shearer travels over a hump or a valley, thereby maintaining sufficient headroom.

13 Claims, 13 Drawing Sheets

ARTICULATED SHEARER

BACKGROUND

In underground mining, longwall shearer machines are commonly used. The shearer mining machine includes a generally rectangular box chassis and a pair of arms. Each of the arms is pivotally coupled to opposite ends of the chassis and supports a rotatable cutting drum. The rotatable cutting drums are equipped with teeth and remove material from a mining face. The shearer mining machine is mounted on an armored face conveyor for movement in a lateral direction substantially parallel to the mining face. In case the mine floor undulates, the shearer mining machine travels over humps and valleys of the mine floor.

SUMMARY

In one embodiment, a longwall shearer mining machine generally includes a first chassis portion with a first cutting arm mounted thereto and a second chassis portion with a second cutting arm mounted thereto. The first and second chassis portions are coupled at a pivot joint.

In another embodiment, a longwall shearer mining machine that is mounted on a rail generally includes a first chassis portion with a first cutting arm mounted thereto and a second chassis portion with a second cutting arm mounted thereto. Each of the first and the second chassis portions is slidably coupled to the rail, and the first and second chassis portions are coupled to each other at a pivot joint. A trapping shoe extends from the pivot joint, and the trapping shoe is slidably coupled to the rail.

In still another embodiment, a longwall shearer mining machine that is mounted on a rail generally includes a first chassis portion with a first cutting arm mounted thereto and a second chassis portion with a second cutting arm mounted thereto. Each of the first and the second chassis portions is slidably coupled to the rail, and the first and second chassis portions are coupled to each other by a rod. A coupling member is spaced apart from the rod, and the coupling member is telescopically extendable between the first and second chassis portions.

Other aspects of the invention will become apparent by consideration of the detailed description and accompanying drawings.

It should be understood that the invention is not limited in its application to the details of construction and the arrangements of the components set forth in the following description or illustrated in the above-described drawings. The invention is capable of other embodiments and of being practiced or being carried out in various ways. Also, it is to be understood that the phraseology and terminology used herein is for the purpose of description and should not be regarded as limiting.

DETAILED DESCRIPTION

Figure 1:
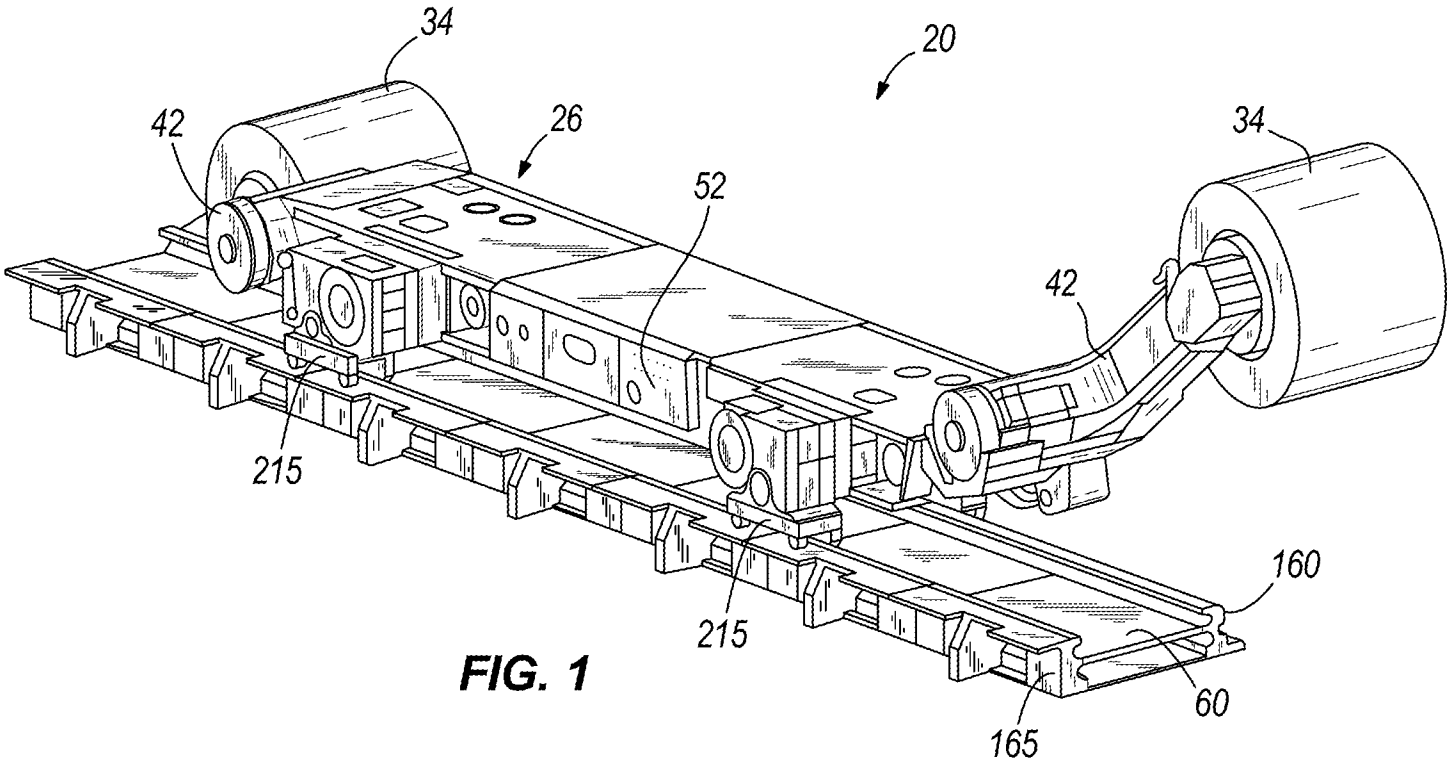
FIG. 1 is a perspective view of a conventional shearer mining machine.

FIG. 1 is a perspective view of a conventional longwall shearer mining machine 20. The shearer mining machine 20 includes a chassis 26 with a pair of movable arms 42, each arm 42 located at an opposite end of the chassis 26. Each arm 42 supports a rotatable cutting drum 34 including teeth (not shown) for removing material from a mining face (not shown). The chassis 26 is a generally rectangular box that measures longer in a lateral direction generally extending between the cutting arms 42, and shorter in a direction that is perpendicular to the lateral direction. The shearer mining machine 20 is mounted on an armored face conveyor 60 for movement in a lateral direction substantially parallel to the mining face. The material removed from the mining face is collected on the face conveyor 60, which carries the material away from the mining area for further processing.

Figure 2A:
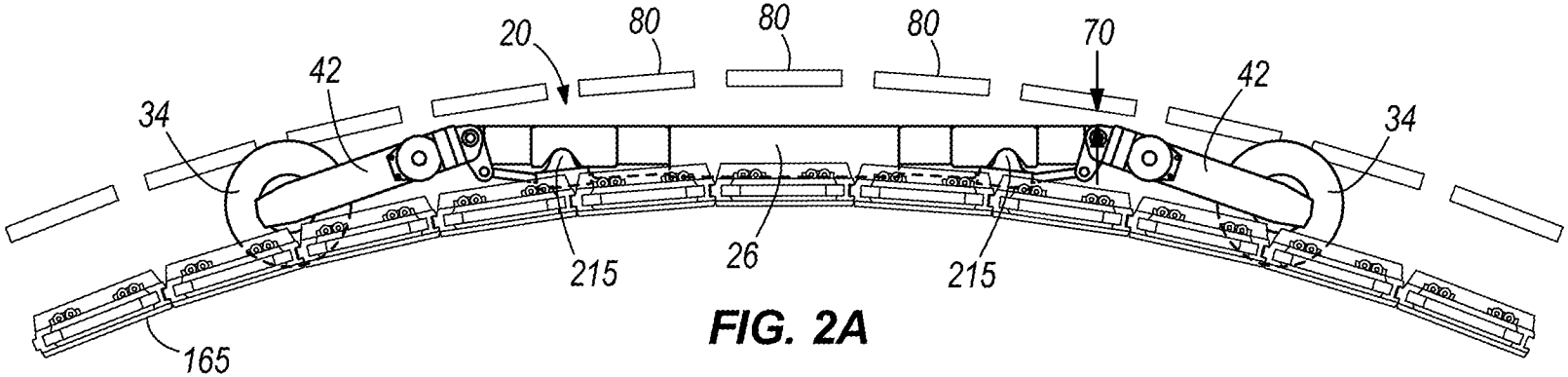
FIG. 2A is a side view of the conventional shearer mining machine of FIG. 1 travelling over a hump of a mine floor.
Figure 2B:
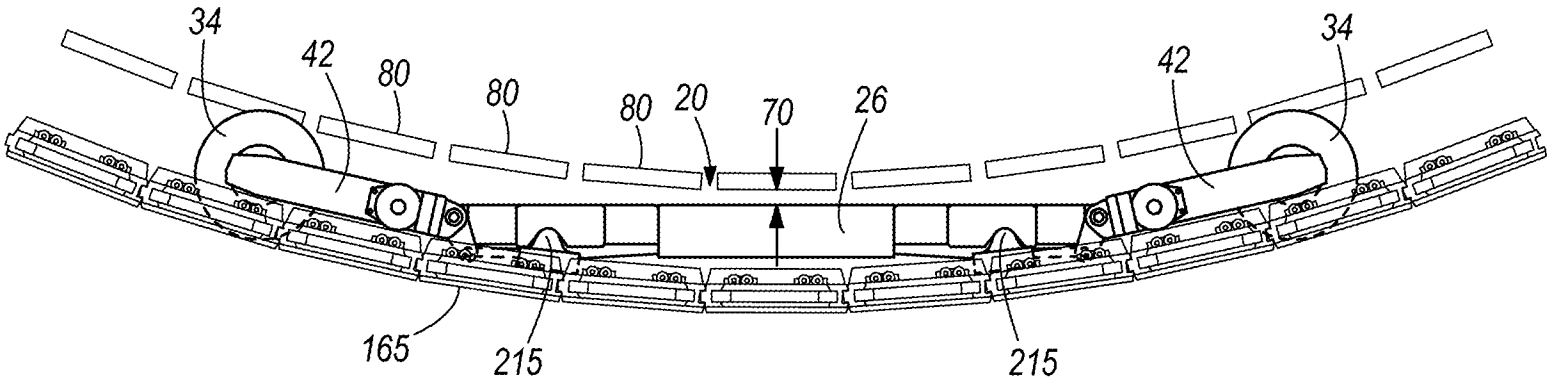
FIG. 2B is a side view of the conventional shearer mining machine of FIG. 1 travelling through a valley of the mine floor.

Referring to FIGS. 2A and 2B, the mine floor (not shown) and the face conveyor 60 may include undulations, in which case the shearer mining machine 20 travels over humps (FIG. 2A) and through valleys (FIG. 2B). When traveling over an undulation of the mine floor, the headroom or clearance 70 for the chassis 26 may be significantly reduced. For instance, in one configuration, the height from the mine floor to the mine roof (not shown) is approximately 1300 mm. The mine roof includes canopies of powered roof supports 80 that are approximately 225 mm in height. The mine floor supports the face conveyor 60, which measures approximately 330 mm in height. These configurations leave approximately 745 mm for the height of the shearer chassis 26 and headroom 70. The headroom 70 is significantly reduced when the rectangular box chassis 26 travels over humps and through valleys that extend along the lateral direction. If the headroom 70 is insufficient, the shearer mining machine 20 can get stuck or ironbound between the top of the chassis 26 and the underside of the roof support canopies 80.

Figure 3:
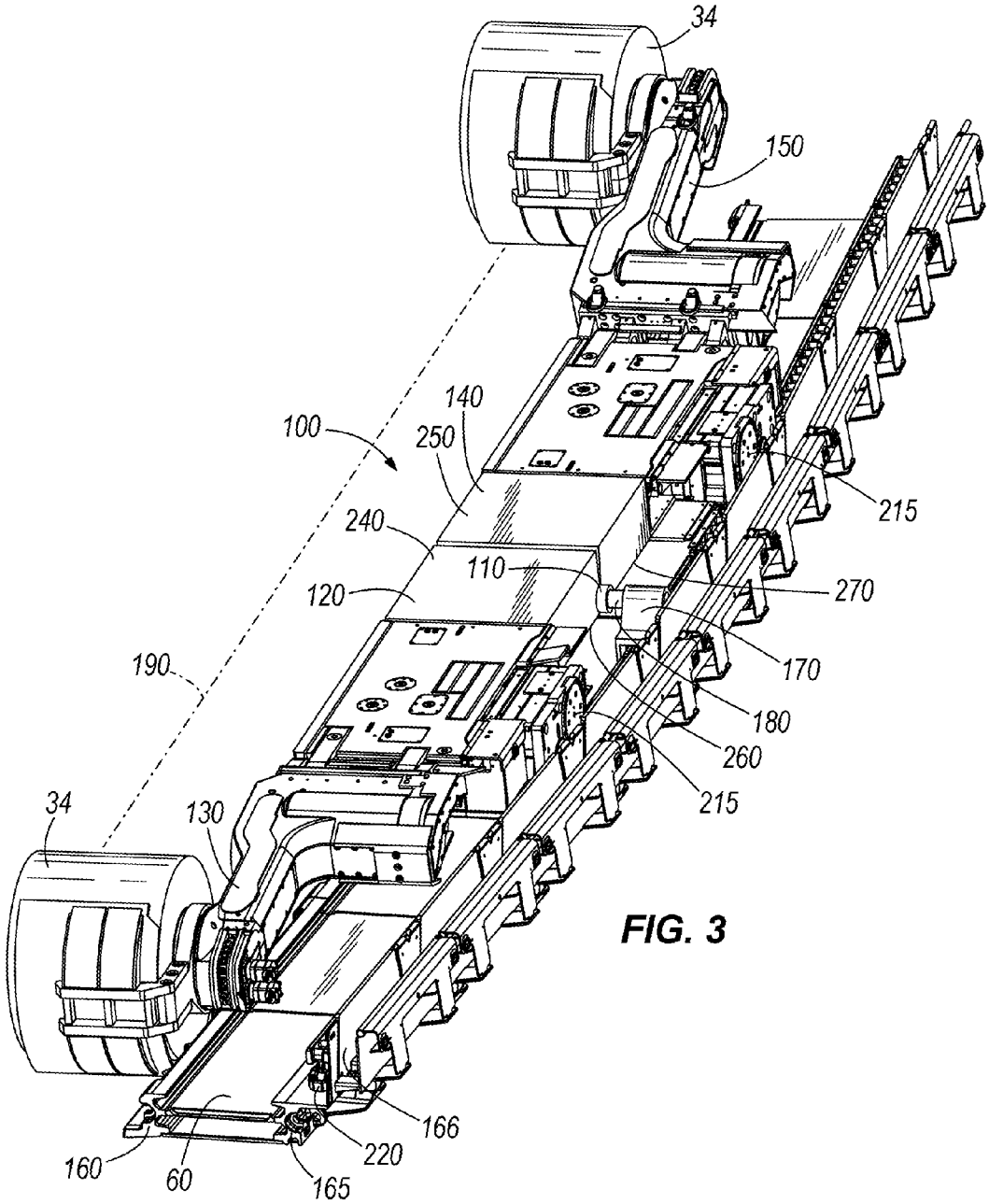
FIG. 3 is a perspective view illustrating an articulated shearer according to one embodiment of the invention.

FIG. 3 illustrates a shearer mining machine 100 with a pivot joint 110. The longwall shearer mining machine 100 includes a first chassis portion 120 with a first cutting arm 130 mounted thereto, and a second chassis portion 140 with a second cutting arm 150 mounted thereto. The first and second chassis portions 120, 140 are hingedly coupled to each other at the pivot joint 110. The articulated shearer 100 is mounted on the armored face conveyor 60 such that the shearer mining machine 100 moves in a lateral direction substantially parallel to the mining face. The face conveyor 60 includes a frame having parallel rails 160, 165 extending along the frame. The shearer mining machine 100 includes two inboard (i.e., closest to the mining face during operation) track shoes 210 (FIGS. 6 and 8) that are mounted to and ride upon the inboard rail 160. Each of the inboard track shoes 210 is positioned on a respective inboard lateral end portion of the first and second chassis portions 120, 140. The shearer mining machine 100 also includes two outboard track shoes 215 (FIG. 5) that are mounted to and ride upon a substantially upturned side portion with a rack 220 of the outboard rail 165. The rack 220 includes drive teeth 225 that are engaged by corresponding teeth (not shown) formed on sprockets (not shown) coupled to the outboard track shoes 215 such that the shearer mining machine 100 may be driven on the face conveyor 60. A spill plate 166 extends at an angle away from the face conveyor 60 just outboard of the rack 220. The spill plate 166 extends upwardly and away from the mining floor such that material removed from the mining face does not fall behind the face conveyor 60 and instead is guided onto the face conveyor 60.

Figure 4A:
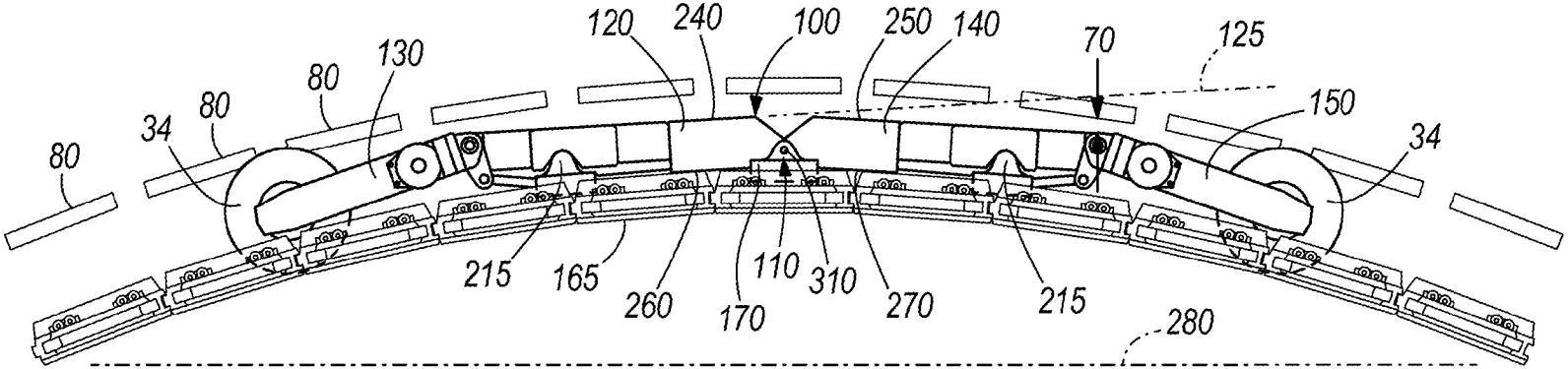
FIG. 4A is a side view of the articulated shearer of FIG. 3 travelling over a hump of the mine floor.
Figure 4B:
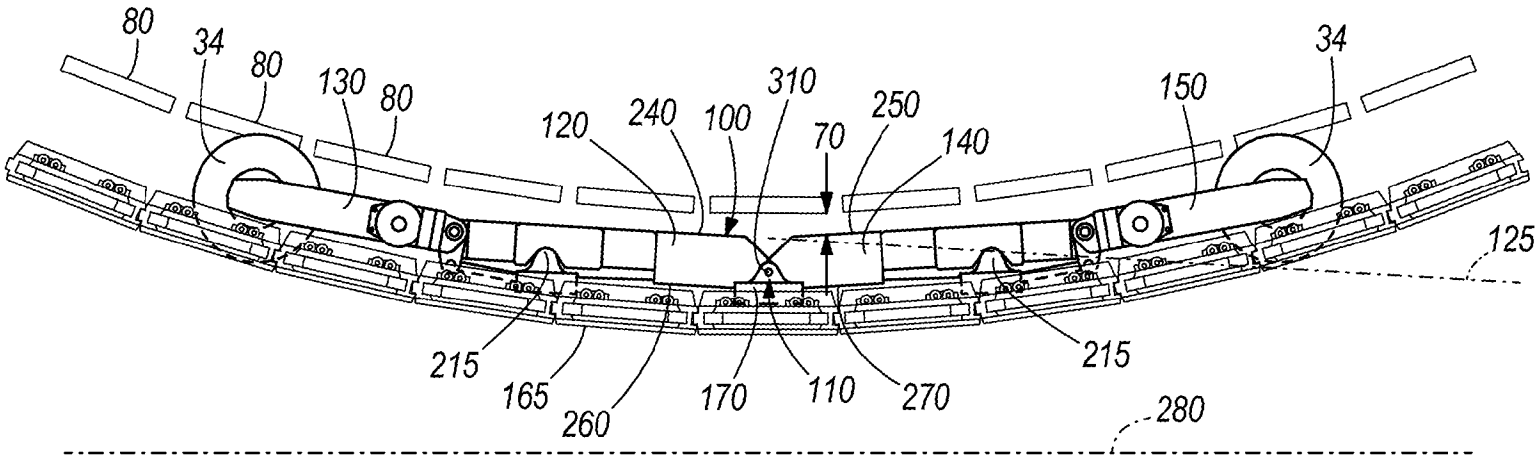
FIG. 4B is a side view of the articulated shearer to FIG. 3 travelling through a valley of the mine floor.

FIGS. 4A and 4B are side views of the articulated shearer 100 with the pivot joint 110, travelling over a hump (FIG. 4A) or through a valley (FIG. 4B) of the mine floor. In the illustrated embodiment, the pivot joint 110 includes female and male members 128, 148 located adjacent the center of the articulated shearer 100, a rod 310, a pin 180, and a trapping shoe 170. Also referring to FIG. 5, in the illustrated embodiment, the second chassis portion 140 includes male member 148 adjacent a center of the articulated shearer 100, the male member 148 including a hole that extends through the member. The first chassis portion 120 includes female member 128 that matingly receives the male member 148. Similar to the male member 148, the female member 128 includes a respective hole that extends through the member. When the holes of the male and the female members 148, 128 are aligned, a rod 310 is inserted through the holes. Although in the illustrated embodiment only a single female member 128 on the first chassis portion 120 and only a single male member 148 on the second chassis portion 140 are shown, in further embodiments, the first chassis portion 120 may include one or more female members 128, one or more male members 148, or some combination thereof. Similarly, the second chassis portion 140 may also include one or more female members 128, one or more male members 148, or some combination thereof. The pivot joint 110 thus suitably includes one or more female and male members 128, 148.

The rod 310 allows each of the first and the second chassis portions 120, 140 to adjust its respective orientation with respect to a horizontal ground plane 280. As an illustration of how the orientations of the first and the second chassis portions 120, 140 are measured with respect to the ground plane 280, when the articulated shearer 100 travels over a mine floor that does not contain undulations, both the first and second chassis portions 120, 140 are at an identical angle of 0° from the ground plane 280. When the articulated shearer 100 travels through a valley, however, the first and second chassis portions 120, 140 are at different non-zero angles. For example, when the articulated shearer is at the bottom of a valley, the first and second chassis portions 120, 140 of the shearer 100 will be positioned on each of the valley slopes, giving the appearance of a V shape. If the first chassis portion 120 is inclined upward relative to the ground plane 280, the second chassis portion 140 will be inclined downward relative to the ground plane 280. The orientations of each chassis portion 120, 140 are therefore different when the articulated shearer travels through a valley. Furthermore, when the articulated shearer 100 is at the top of a hump or the bottom of a valley, the second chassis portion 140 is oriented to a maximum angle from a reference axis 125 that extends along the lateral direction of the first chassis portion 120. In contrast, when the articulated shearer 100 is away from the top of a hump or the bottom of a valley, the second chassis portion 140 is oriented to a smaller angle from the reference axis 125 of the first chassis portion 120.

By adjusting the respective orientations of the first and second chassis portions 120, 140 through the pivot joint 110, the articulated shearer 100 maintains sufficient headroom 70 between the chassis and the mine roof. As described above, when the articulated shearer 100 travels through the bottom of a valley (FIG. 4B), the articulated shearer adjusts the first chassis portion 120 to be angled upward relative to horizontal ground plane 280, and the second chassis portion 140 to be oriented downward relative to the horizontal ground plane 280, to a maximum angle from reference axis 125 that extends along the lateral direction of the first chassis portion 120. This has the effect of lowering the center of the articulated shearer 100 closer to the mine floor, thereby gaining additional headroom 70 adjacent the center of the articulated shearer 100, compared to prior art configurations. In one configuration, additional headroom of as much as approximately 115 mm can be gained compared to prior art configurations. The additional headroom prevents the articulated shearer 100 from getting stuck or ironbound between the respective top side 240, 250 of the first and second chassis portions 120, 140 adjacent the center of the articulated shearer 100 and the underside of the roof support canopies 80.

Compared to prior art configurations, the pivot joint 110 also enables the articulated shearer 100 to mine lower relative to the mine floor. When the articulated shearer 100 travels over the top of a hump (FIG. 4A), the first and second chassis portions 120, 140 of the shearer 100 will be positioned on each of the hump slopes, giving the appearance of an inverted V shape. Again in contrast to prior art configurations, the pivot joint 110 adjusts the respective orientations of the first and second chassis portions 120, 140 with respect to the mine floor. The first chassis portion 120 in this case is adjusted to be angled downward relative to the horizontal ground plane 280, and the second chassis portion 140 is adjusted to be angled upward relative to the horizontal ground plane 280. This has the effect of lifting the center of the articulated shearer 100 upwardly and away from the mine floor, which prevents the respective underside 260, 270 of the first and second chassis portions 120, 140 adjacent the center of the articulated shearer 100 from getting stuck or ironbound with the rails 160, 165 of the face conveyor 60.

Figure 5:
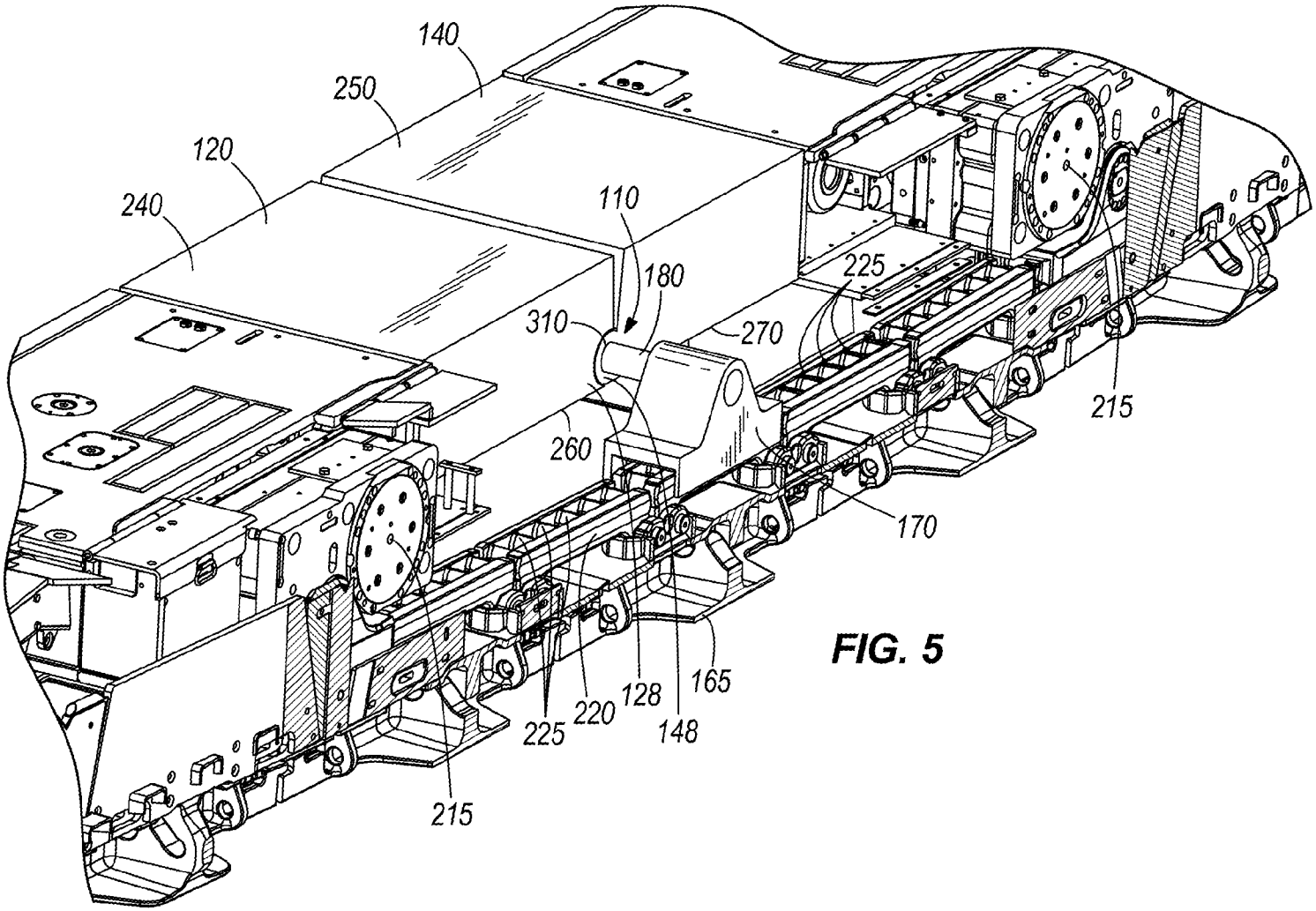
FIG. 5 is an enlarged perspective view of the articulated shearer of FIG. 3 illustrating a trapping shoe engaging a rail.
Figure 6:
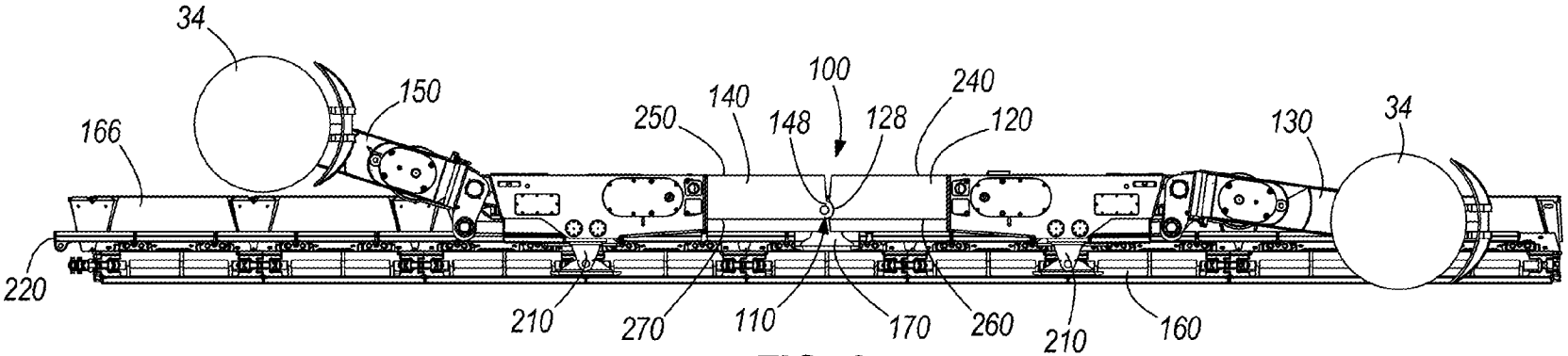
FIG. 6 is a side view from a mine face illustrating the articulated shearer of FIGS. 3 and 5.
Figure 7:
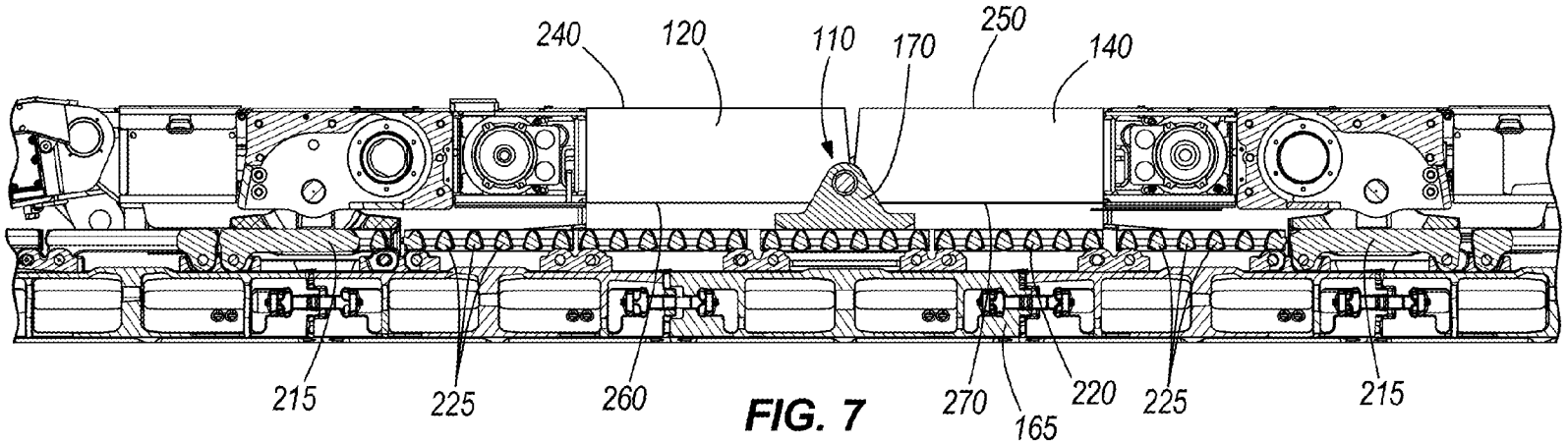
FIG. 7 is a cross-sectional view of the articulated shearer.

Referring to FIGS. 5-7, in the illustrated embodiment the shearer mining machine 100 includes a trapping shoe 170, which engages the rack 220 of the rail 165. When the shearer mining machine 100 travels through a valley (FIG. 4B), the mining machine 100 may lift up off of the rail 160 near the location of the pivot joint 110. The trapping shoe 170 prevents this by engaging the rack 220 of the rail 165 and thereby keeping the first and second chassis portions 120, 140 in contact with the rails 160, 165 of the face conveyor 60. The trapping shoe 170 extends from and couples to the rod 310 through a pin 180 (FIG. 5). In the illustrated embodiment, the rod 310 is integral with the pin 180. Other embodiments may include a rod 310 that is separate from, but concentric with, the pin 180. The trapping shoe 170 is coupled to a sprocket (not shown), which includes teeth (not shown) that engage the drive teeth 225 of the rack 220, thereby slidably coupling the trapping shoe 170 to the rack 220 of the rail 165. In the illustrated embodiment, the trapping shoe 170 is also movable along the pin 180, perpendicular to a lateral axis 190 (FIG. 3) that generally extends from the first cutting arm 130 to the second cutting arm 150. In case the mine floor snakes through the mine seam, there may be curves in the rails 160, 165 of the face conveyor 60. When the shearer mining machine 100 negotiates a turn, the pin 180 extends and retracts with respect to the first and second chassis portions 120, 140 so that the trapping shoe 170 can move perpendicular to the lateral axis 190.

Figure 8:
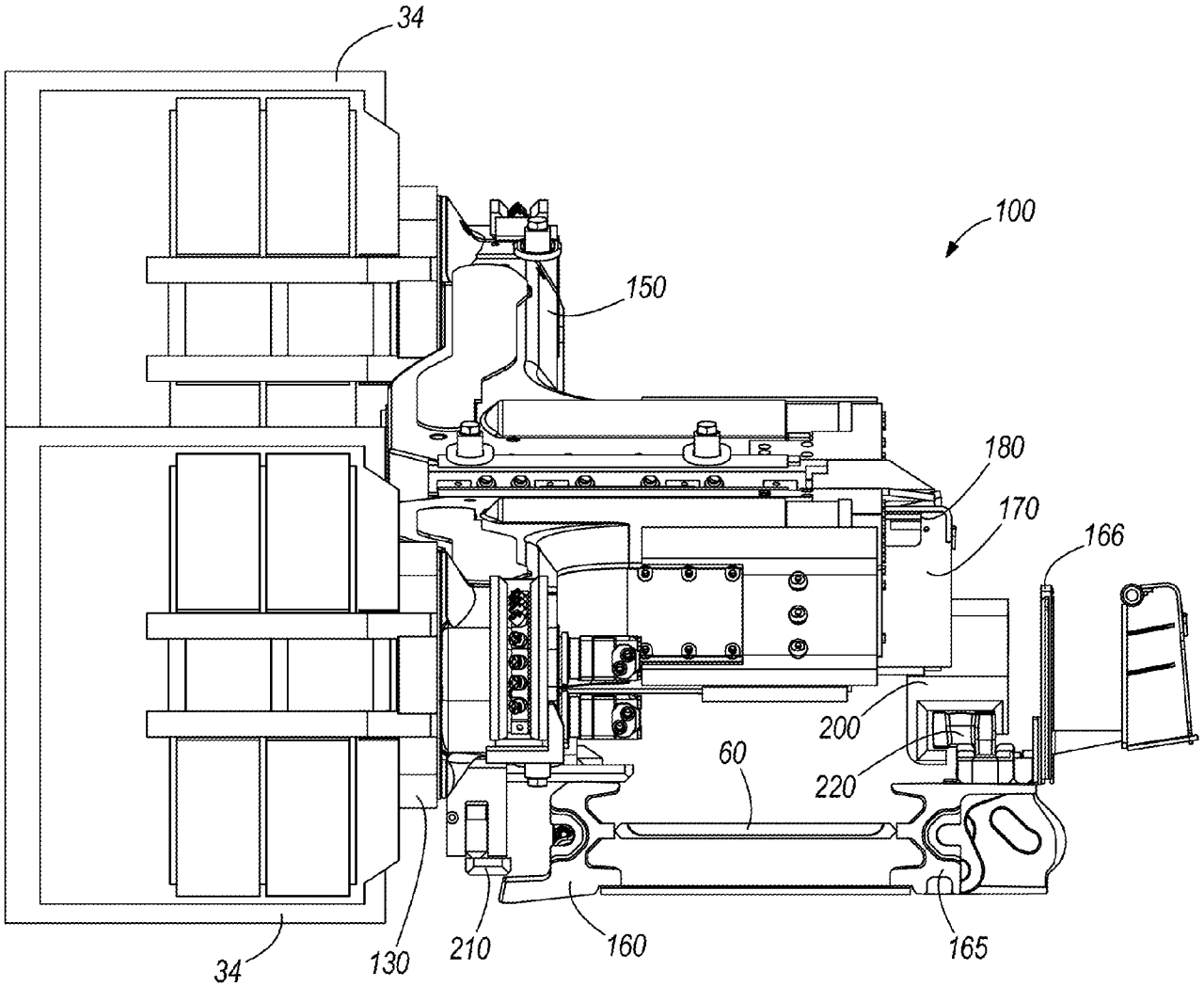
FIG. 8 is an end view illustrating the trapping shoe of FIG. 5 engaged with the rail.

FIG. 8 illustrates the trapping shoe 170, which includes an engagement member 200 that engages the rack 220 of the rail 165. The engagement member 200 of the trapping shoe 170 is located adjacent a center of the articulated shearer 100. By hooking around the rack 220 of the rail 165, the engagement member 200 constrains the shearer mining machine 100 to the rails 160, 165 in all directions except for the direction of travel.

Figure 9:
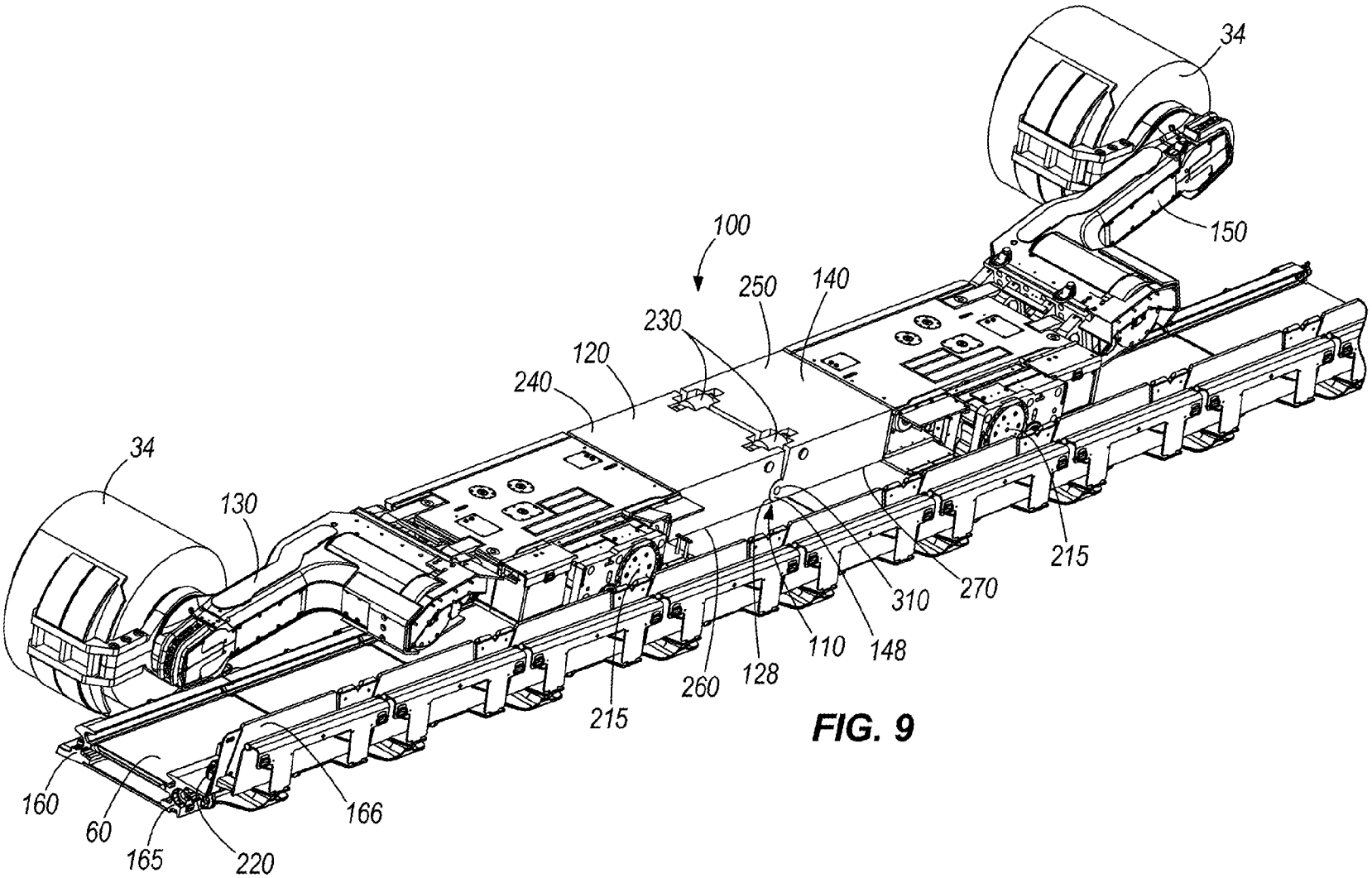
FIG. 9 is a perspective view of an articulated shearer according to another embodiment of the invention.
Figure 10:
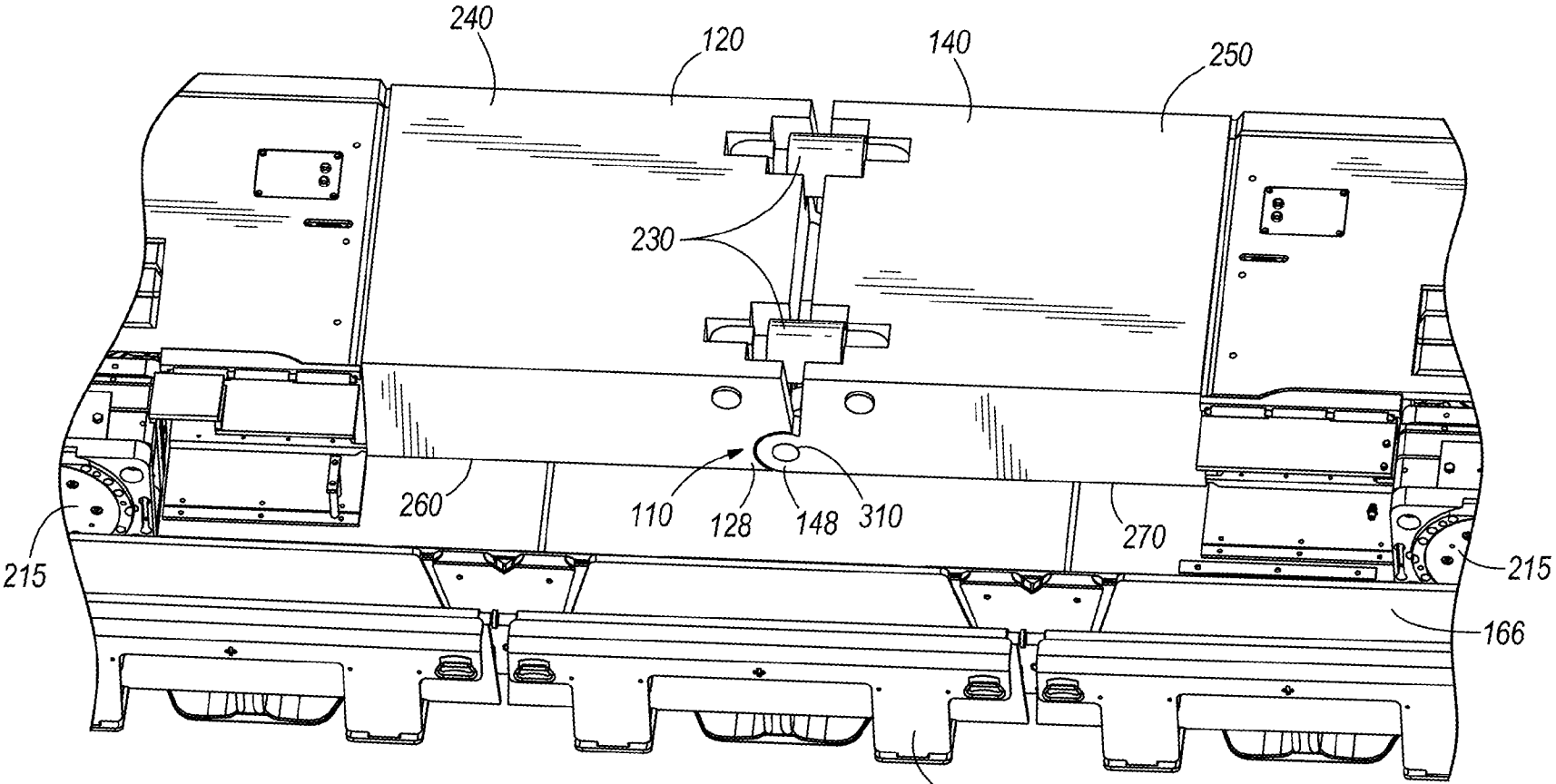
FIG. 10 is an enlarged perspective view of the articulated shearer shown in FIG. 9, with a coupling member in a retracted position.
Figure 11:
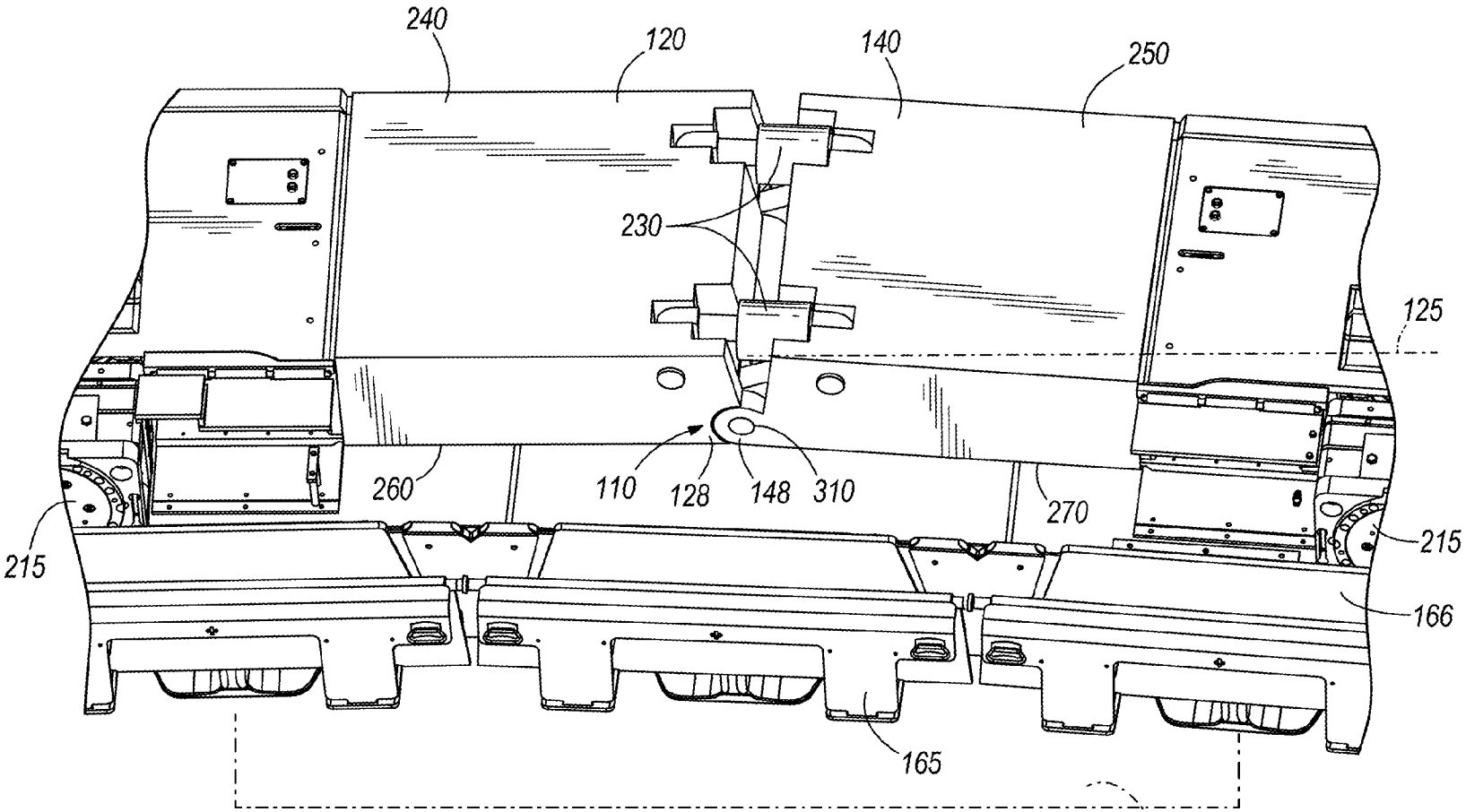
FIG. 11 is an enlarged perspective view of the articulated shearer shown in FIG. 9, with the coupling member in an extended position.

FIGS. 9-11 illustrate the shearer mining machine 100 including a pivot joint 110 according to another embodiment of the invention. The pivot joint 110 in this embodiment includes the female and male members 128, 148 located adjacent the center of the articulated shearer 100, the rod 310, and a pair of coupling members 230, which are spaced apart from the rod 310 and are telescopically extendable between the first and second chassis portions 120, 140. In another embodiment, fewer or more coupling members 230 may be used. The coupling members 230 adjust the respective orientations of the first and second chassis portions 120, 140. The coupling members 230 pivot the first and second chassis portions 120, 140 around the rod 310 and thereby adjust the angle between the first and second chassis portions 120, 140. In the illustrated embodiment, the coupling members 230 are powered cylinders. The coupling members 230 are positioned adjacent the respective top side 240, 250 of the first and second chassis portions 120, 140. The rod 310 is adjacent the respective underside 260, 270 of the first and second chassis portions 120, 140.

Referring to FIGS. 10-11, when the shearer mining machine 100 of the illustrated embodiment travels through a valley, the coupling members 230 retract (FIG. 10), thereby keeping the first and second chassis portions 120, 140 adjacent to the rail 160. On the other hand, when the shearer mining machine 100 travels over a hump, the coupling members 230 extend (FIG. 11), thereby maintaining sufficient headroom 70. The extended and retracted configurations may be accomplished by means of mechanical, hydraulic, pneumatic, or electric systems depending upon the capabilities and configuration of the coupling members 230. In some embodiments, the coupling members 230 are automatically extendable and retractable when the shearer mining machine 100 travels over humps and valleys of the mine floor. For example, the shearer mining machine 100 may include various sensors, transducers, cameras, and the like that provide information such as the undulation of the mine floor and the respective orientation of the first and the second chassis portions 120, 140. The coupling members 230 may be operable to extend and retract in response to information received from the sensors.

Figure 12:
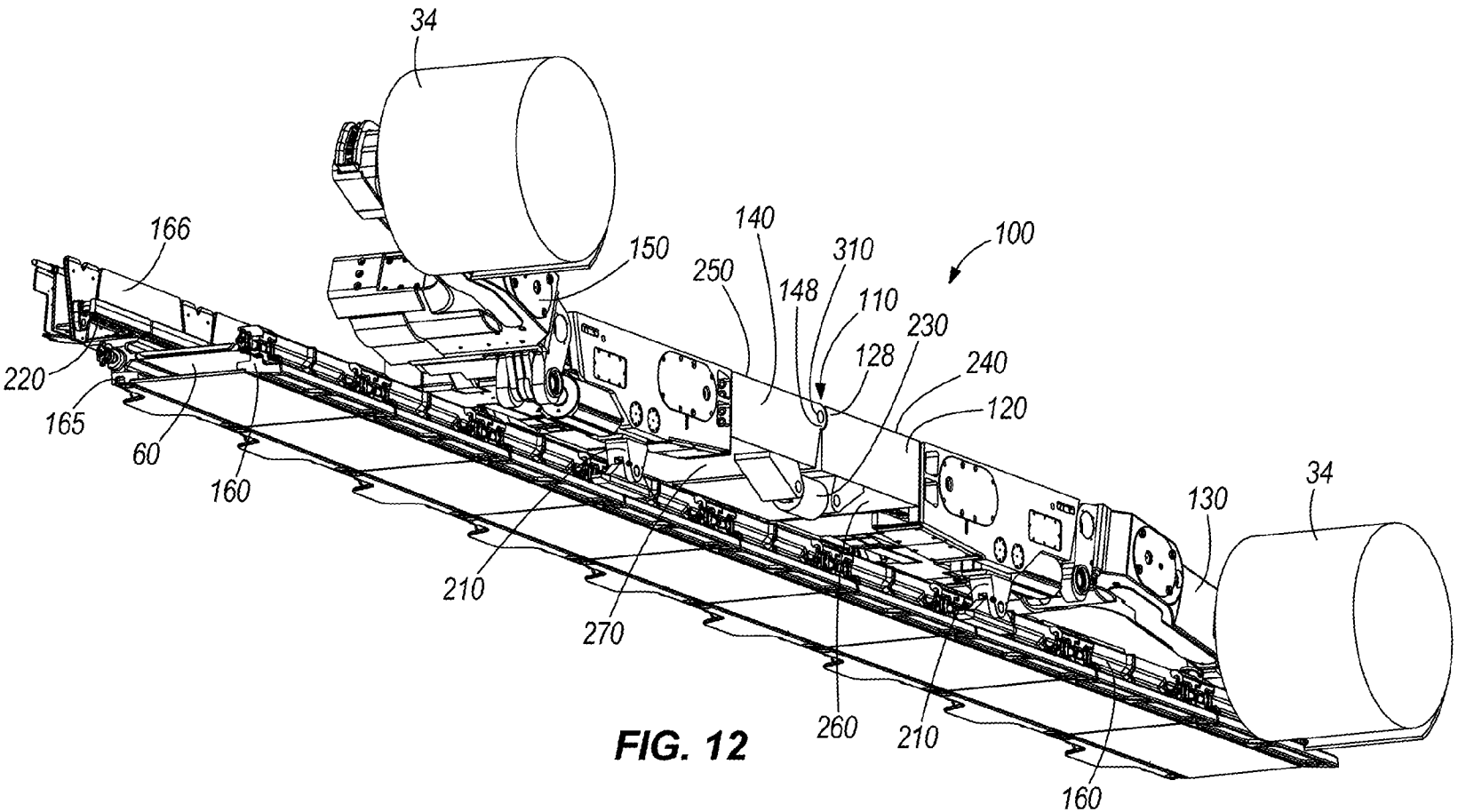
FIG. 12 is a perspective view of an articulated shearer according to yet another embodiment of the invention.
Figure 13:
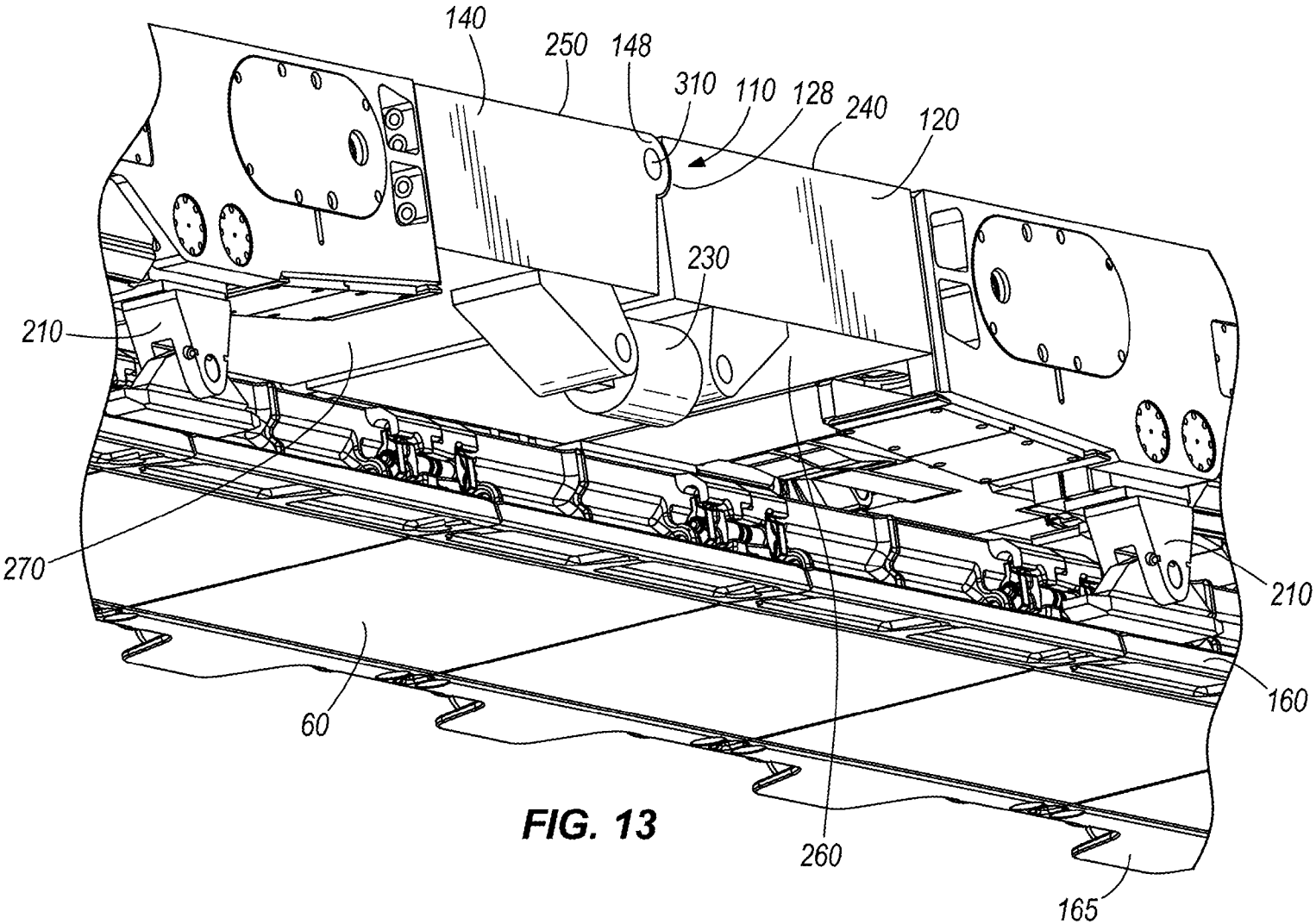
FIG. 13 is an enlarged perspective view of the articulated shearer shown in FIG. 12, with a coupling member in a retracted position.
Figure 14:
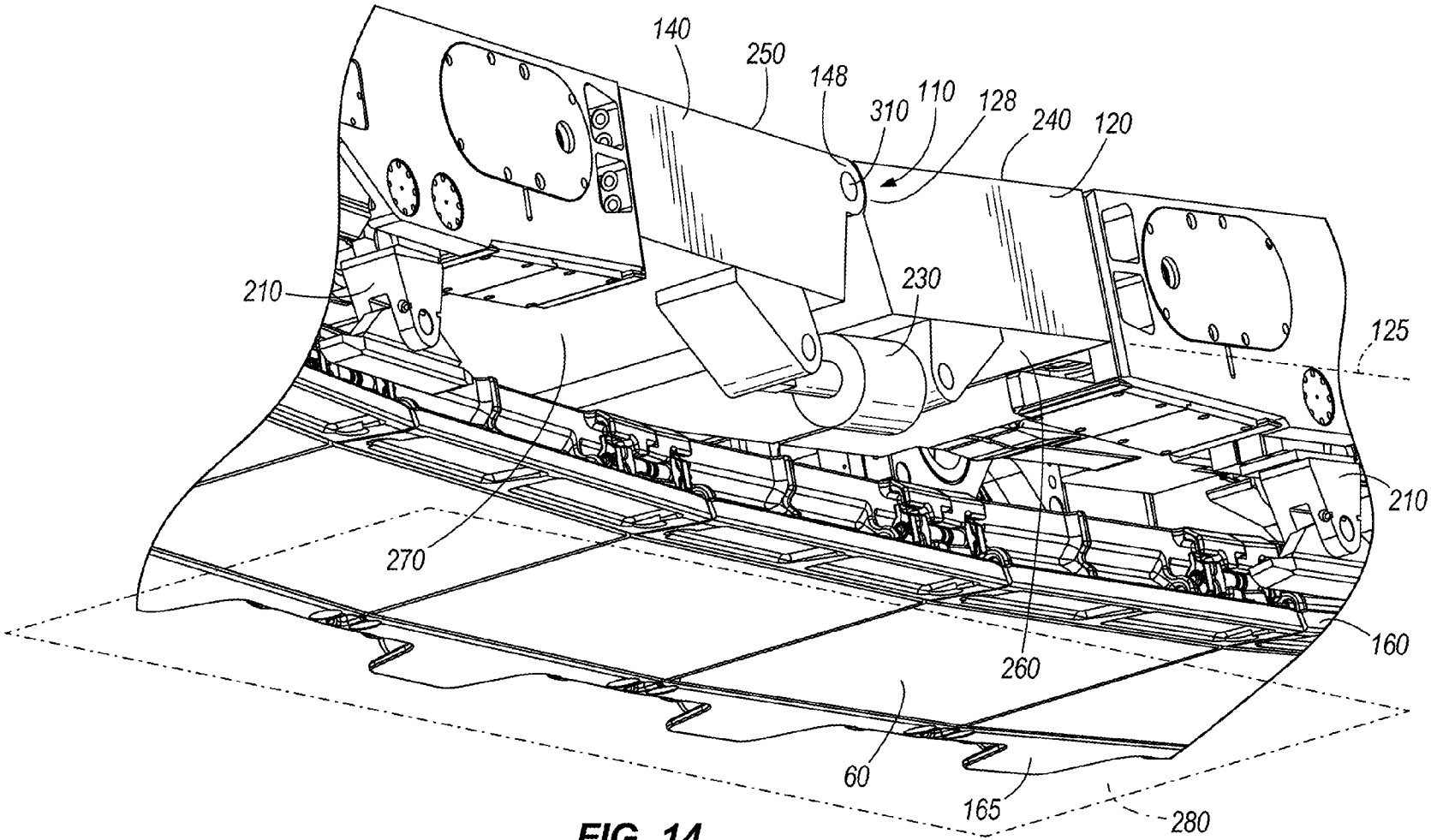
FIG. 14 is an enlarged perspective view of the articulated shearer shown in FIG. 12, with the coupling member in an extended position.

FIGS. 12-14 illustrate the shearer mining machine 100 including a pivot joint 110 according to still another embodiment of the invention. Similar to FIGS. 9-11, the coupling members 230 are spaced apart from the rod 310. However, the coupling members 230 are positioned adjacent the respective underside 260, 270 of the first and second chassis portions 120, 140, and the rod 310 is positioned adjacent the respective top side 240, 250 of the first and second chassis portions 120, 140. When the shearer mining machine 100 travels over a hump, the coupling members 230 retract (FIG. 13), thereby maintaining sufficient headroom 70. On the other hand, when the shearer mining machine 100 travels through a valley, the coupling members 230 extend (FIG. 14), thereby keeping the first and second chassis portions 120, 140 adjacent to the rail 160. Similar to the embodiments illustrated in FIGS. 9-11, the coupling members 230 in the embodiments illustrated in FIGS. 12-14 may be operable by means of mechanical, hydraulic, pneumatic, or electric systems. Furthermore, the coupling members 230 may be automatically extendable and retractable in response to information received from various sensors, transducers, cameras, and the like.

Although the invention has been described in detail with reference to certain preferred embodiments, variations and modifications exist within the scope and spirit of one or more independent aspects of the invention as described.

What is claimed is:

1. A longwall shearer mining machine comprising:

a first chassis portion with a first cutting arm mounted thereto;

a second chassis portion with a second cutting arm mounted thereto, wherein the first and second chassis portions are coupled at a pivot joint; and a trapping shoe that extends from the pivot joint, wherein the longwall shearer mining machine is mounted on a rail, and the trapping shoe includes at least one engagement member that engages the rail, wherein the longwall shearer mining machine defines a lateral axis that generally extends from the first cutting arm to the second cutting arm, and the trapping shoe is movable perpendicular to the lateral axis.

2. The longwall shearer mining machine of claim 1, wherein the pivot joint includes a female member coupled to one of the first and second chassis portions, a male member coupled to the other of the first and second chassis portions and positioned proximate the female member, and a rod insertable through the female and male members to couple the first and second chassis portions together.

3. The longwall shearer mining machine of claim 1, wherein a portion of the rail defines a rack, and the engagement member hooks around the rack.

4. The longwall shearer mining machine of claim 1 further comprising a coupling member, the coupling member being telescopically extendable between the first and second chassis portions.

5. The longwall shearer mining machine of claim 4, wherein the coupling member pivots the first and second chassis portions around a rod.

6. The longwall shearer mining machine of claim 4, wherein each of the first and the second chassis portions respectively defines a top side and an underside, wherein the pivot joint is positioned adjacent the undersides, and the coupling member is positioned adjacent the top sides.

7. The longwall shearer mining machine of claim 4, wherein each of the first and the second chassis portions respectively defines a top side and an underside, wherein the pivot joint is positioned adjacent the top sides, and the coupling member is positioned adjacent the undersides.

8. A longwall shearer mining machine that is mounted on a rail, the longwall shearer mining machine comprising:

a first chassis portion with a first cutting arm mounted thereto;

a second chassis portion with a second cutting arm mounted thereto, wherein each of the first and the second chassis portions is slidably coupled to the rail, and wherein the first and second chassis portions are coupled to each other at a pivot joint; and a trapping shoe that extends from the pivot joint, the trapping shoe being slidably coupled to the rail, wherein the longwall shearer mining machine defines a lateral axis that generally extends from the first cutting arm to the second cutting arm, and the trapping shoe is movable perpendicular to the lateral axis.

9. The longwall shearer mining machine of claim 8, wherein the pivot joint includes a female member coupled to one of the first and second chassis portions, a male member coupled to the other of the first and second chassis portions and positioned proximate the female member, and a rod insertable through the female and male members to couple the first and second chassis portions together.

10. The longwall shearer mining machine of claim 8, wherein the trapping shoe includes at least one engagement member that engages the rail.

11. The longwall shearer mining machine of claim 10, wherein a portion of the rail defines a rack, and the engagement member hooks around the rack.

12. A longwall shearer mining machine that is mounted on a rail, the longwall shearer mining machine comprising:

a first chassis portion with a first cutting arm mounted thereto;

a second chassis portion with a second cutting arm mounted thereto, wherein each of the first and the second chassis portions is slidably coupled to the rail, and wherein the first and second chassis portions are coupled to each other by a rod; and a coupling member spaced apart from the rod, the coupling member being telescopically extendable between the first and second chassis portions, wherein each of the first and second chassis portions respectively defines a top side and an underside, wherein the pivot joint is positioned adjacent the top sides, and the coupling member is positioned adjacent the undersides.

13. The longwall shearer mining machine of claim 12, wherein each of the first and second chassis portions respectively defines a top side and an underside, wherein the pivot joint is positioned adjacent the undersides, and the coupling member is positioned adjacent the top sides.

* * * * *